US009394578B2

(12) United States Patent
Lee et al.

(10) Patent No.: US 9,394,578 B2
(45) Date of Patent: Jul. 19, 2016

(54) METHOD OF MANUFACTURING MULTI PHYSICAL PROPERTIES PART

(75) Inventors: Hong-Woo Lee, Gwangyang-si (KR); Jae-Hyun Kim, Gwangyang-si (KR); Hyoun-Young Lee, Gwangyang-si (KR); Yeon-Sik Kang, Gwangyang-si (KR)

(73) Assignee: POSCO, Pohang-si (KR)

( * ) Notice: Subject to any disclaimer, the term of this patent is extended or adjusted under 35 U.S.C. 154(b) by 544 days.

(21) Appl. No.: 13/824,504

(22) PCT Filed: Dec. 20, 2011

(86) PCT No.: PCT/KR2011/009855
§ 371 (c)(1),
(2), (4) Date: Mar. 18, 2013

(87) PCT Pub. No.: WO2012/091346
PCT Pub. Date: Jul. 5, 2012

(65) Prior Publication Data

US 2013/0180633 A1 Jul. 18, 2013

(30) Foreign Application Priority Data

Dec. 27, 2010 (KR) ..... 10-2010-0136093

(51) Int. Cl.

| | |
|---|---|
| ***C21D 9/48*** | (2006.01) |
| ***C21D 8/00*** | (2006.01) |
| ***B21D 22/20*** | (2006.01) |
| ***C21D 1/673*** | (2006.01) |

(52) U.S. Cl.
CPC ..... *C21D 8/005* (2013.01); *B21D 22/208* (2013.01); *C21D 1/673* (2013.01); *C21D 9/48* (2013.01); *C21D 2211/008* (2013.01); *C21D 2221/01* (2013.01); *C21D 2221/02* (2013.01)

(58) Field of Classification Search
CPC ..... B21D 22/208; C21D 1/673; C21D 8/005
See application file for complete search history.

(56) References Cited

U.S. PATENT DOCUMENTS

| | | | | |
|---|---|---|---|---|
| 7,540,993 | B2 * | 6/2009 | Reinhold | C21D 9/0006 148/579 |
| 8,702,875 | B2 * | 4/2014 | Kim | C21D 6/00 148/320 |
| 2011/0068519 | A1 * | 3/2011 | Kwon | B21D 37/16 266/87 |
| 2012/0273092 | A1 * | 11/2012 | Ratte | C21D 1/06 148/325 |
| 2013/0098513 | A1 * | 4/2013 | Lee | C21D 8/06 148/598 |
| 2015/0027602 | A1 * | 1/2015 | Murakami | C21D 9/00 148/653 |

FOREIGN PATENT DOCUMENTS

| | | |
|---|---|---|
| JP | 2000017377 A | 1/2000 |
| JP | 2000-190099 | 7/2000 |

(Continued)

*Primary Examiner* — Veronica F Faison
(74) *Attorney, Agent, or Firm* — The Webb Law Firm

(57) ABSTRACT

A multi physical properties part used in automotive components required to be lightweight and provide collision safety, and a method of manufacturing a multi physical properties part, in which the multi physical properties part may be more economically and simply manufactured by using two or more separated die sets without using an additional heating device or treating a die surface. A method of manufacturing a multi physical properties part, which includes positioning a single heated formed article in two or more die sets, and then manufacturing a multi physical properties part including two or more regions having different physical properties by differing cooling conditions in the respective die set.

10 Claims, 11 Drawing Sheets

(56) References Cited

FOREIGN PATENT DOCUMENTS

| | | | |
|---|---|---|---|
| JP | 2003-328031 | | 11/2003 |
| JP | 2005-161366 | | 6/2005 |
| JP | 2006-326620 | | 7/2006 |
| JP | 2008018447 | A | 1/2008 |
| KR | 100951042 | B1 | 3/2010 |
| KR | 1020100096832 | A | 9/2010 |

* cited by examiner

PRIOR ART (a)

METHOD OF MANUFACTURING MULTI PHYSICAL PROPERTIES PART

TECHNICAL FIELD

The present invention relates to a multi physical properties part used in automotive components required to be lightweight yet provide collision safety, and more particularly, to a method of more economically and simply manufacturing a multi physical properties part by using a separable press die.

BACKGROUND ART

Vehicle emission regulations have become increasingly stringent, according to recently strengthened environmental and safety regulations. That is, in order to cope with the requirement to be lightweight yet provide improvements in collision safety for improving fuel economy, applications for high-strength steels including, for example, an advanced high-strength steel (AHSS), have increased.

In particular, applications for ultra high-strength steels having a strength of 1000 MPa or more are inevitable, and various methods for the formation thereof have been researched and developed.

As shown in FIG. 1, since elongation becomes very low instead of securing high tensile strength with respect to ultra high-strength steels, there exist many limitations in the formation thereof.

A hot press forming (referred, to simply as 'HPF') technique was developed as a method for resolving the foregoing limitations, and the HPF technique is a technique of manufacturing parts using press hardening characteristics.

The HPF technique is a new sheet forming method, in which a sheet of a material having high hardenability, such as a boron steel, is heated to a high temperature, and then formed by using a die at room temperature. The HPF technique has been applied to dozens of automotive parts, focusing on European and American automobiles, after the technique was developed by a Swedish steel maker, SSAB plannja AB, in 1973. Recently, the applications thereof have also been increased in South Korea.

The HPF process is a processing method, in which a steel having improved hardenability by adding elements with high hardenability, such as boron (B), molybdenum (Mo), or chromium (Cr), is heated above an $Ac_3$ transformation point, a high temperature of about 900° C., and a product is then immediately hot formed in a press die and rapidly cooled to manufacture a high-strength product.

FIG. 2 schematically illustrates a HPF process.

The HPF process may be categorized as a direct method and an indirect method, and each method is briefly illustrated in FIG. 3.

As shown in FIG. 3, the direct method is a method of simultaneously performing press forming and die quenching at high temperatures, and the indirect method is a method of die quenching by heating at high temperatures after partially or completely forming a part at room temperature.

The advantages and disadvantages of each method are described below.

1) The direct method has an advantage in that the process thereof is simple, because forming and quenching are performed in a die set at the same time, but has a disadvantage that there are limitations in manufacturing drawing type parts, because friction characteristics are very poor at high temperatures.

2) The indirect method has disadvantages that the process thereof must be divided into two because press forming must first be performed at room temperature and as a result, processing costs increase in comparison to the direct method, but has an advantage that the manufacturing of drawing type complex parts is possible because the direct method is a room temperature forming method.

Meanwhile, parts applied for a crash member may largely be categorized into two types.

First, an energy absorption part is a part that absorbs impacts applied from the outside through deformation.

Typically, a front side of a front side member, a rear side of a rear side member, and a lower side of a B-pillar correspond to energy absorption parts.

Second, an anti-intrusion part is a part in which deformation is almost not generated. For example, since a cabin zone including passengers needs to be secured during crash, crash members applied thereto mostly correspond to anti-intrusion parts.

Typically, the anti-intrusion part may include a rear side of the front side member, a front side of the rear side member, and an upper side of the B-pillar. Therefore, cases of improving crashworthiness by applying HPF are rapidly increased with respect to the anti-intrusion part, and AHSS having relatively high elongation has been applied to the energy absorption part.

As described above, members, such as the front side member, the rear side member, and the B-pillar, have a form in which an energy absorption part and an anti-intrusion part are combined with each other, and have generally been used by respectively forming two parts and welding them together.

In order to resolve the foregoing limitation of the respective forming of the two parts, a method of applying HPF steel and general high-strength steel by making a tailor welded blank (TWB) and a method of obtaining different strengths in a single part by differing heat treatment characteristics for sections have been suggested.

In particular, the method of obtaining differences in strengths by differing heat treatment characteristics is largely divided by cooling rate control and heating temperature control methods.

The heating temperature control method is a method of controlling phase transformation by differing heating temperatures in a high-strength region and a high-elongation region, and has an advantage that maintaining a short cycle time is possible, but has a disadvantage that an additional heating device may be necessary.

Meanwhile, the cooling control method includes a method of controlling a cooling rate by setting a die temperature of a high-elongation region to be high and a method of controlling a contact area by setting a gap or a groove of the high-elongation region to be large. The former has an advantage in that the realization thereof may be easy, but has disadvantages that a device for controlling the die temperature may be necessary and a cycle time may increase, and the latter has disadvantages in that processing may be necessary for a complex die, and a cycle time may increase, although the method is conceptually possible.

An aspect of the present invention provides a method of manufacturing a multi physical properties part, in which the multi physical properties part may be more economically and simply manufactured by using two or more separated die sets, without using an additional heating device or treating a die surface.

SUMMARY OF THE INVENTION

Hereinafter, the present invention will be described.

According to an aspect of the present invention, there is provided a method of manufacturing a multi physical properties part including: positioning a single heated formed article in two or more separated die sets; and then manufacturing the single heated formed article into a multi physical properties part including two or more regions having different physical properties by differing cooling conditions in the respective die set.

The formed article may be formed by using the two or more die sets and may be manufactured as a multi physical properties part including two or more regions having different physical properties by differing cooling conditions in the respective die set, after the forming.

The physical properties, for example, may be selected from the group consisting of yield strength, tensile strength, elongation, toughness, a plastic anisotropy index (r), and in-plane anisotropy (Δr).

A physical property may be tensile strength, and at this time, a critical cooling rate (CCR), a minimum cooling rate able to form a martensite phase in a continuous cooling transformation (CCT) curve of the steel, may be greater than about 50° C./s and less than about 600° C./s.

A method of manufacturing a multi strength part by using a steel having the foregoing CCR, for example, may include: forming and pre-quenching the steel by using two or more separated die sets, after heating the steel above an $Ac_3$ transformation point; air cooling a region to obtain a relatively low-strength region, in which the die set and a formed article are not allowed to be in contact with each other, and then post-quenching while the die set and the formed article are in contact with each other again; and die quenching a region to obtain a relatively high-strength region, in which the die set and the formed article are continuously in contact with each other after the forming and pre-quenching.

Martensite, for example, may be predominantly formed to about 80 vol % or more in the high-strength region, and one or more of ferrite, bainite, and pearlite or one or more of ferrite, bainite, and pearlite and about 50 vol % or less of martensite may be formed in the low-strength region.

According to the present invention, since a multi physical properties part may be manufactured by using two or more separated die sets, the multi physical properties part may be manufactured more economically and simply without using an additional heating device or treating a die surface.

DESCRIPTION OF DRAWINGS

The above and other aspects, features and other advantages of the present invention will be more clearly understood from the following detailed description taken in conjunction with the accompanying drawings, in which.

DETAILED DESCRIPTION OF THE INVENTION

Hereinafter, the present invention will be described in more detail.

In the present invention, a single heated steel is formed by using two or more separated die sets or a single heated formed article is positioned in two or more separated die sets, and a multi physical properties part including two or more regions having different physical properties is then manufactured therefrom by differing cooling conditions in the respective die set.

The physical properties are not particularly limited so long as the physical properties are changed according to a cooling rate of a steel or a part, and for example, may include one selected from the group consisting of yield strength, tensile strength, elongation, toughness, a plastic anisotropy index (r) and in-plane anisotropy (Δr).

Steels applied to the present invention are not particularly limited so long as physical properties thereof are changed according to a cooling rate and the steels may include alloys or the like.

For example, steels having an appropriate critical cooling rate (CCR; a minimum cooling rate able to form a martensite phase in a continuous cooling transformation (CCT) curve) may be used in order to manufacture a multi strength part.

It is necessary to prepare a forming apparatus including two or more die sets in order to manufacture a multi physical properties part according to the present invention.

Figure 1:
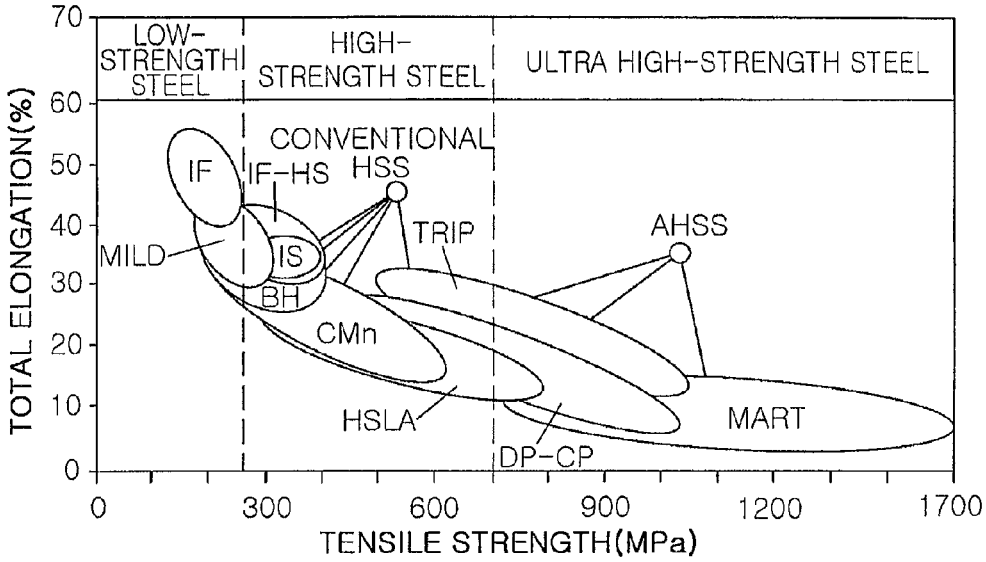
FIG. 1 is a strength-elongation diagram of typical steels.
Figure 2:
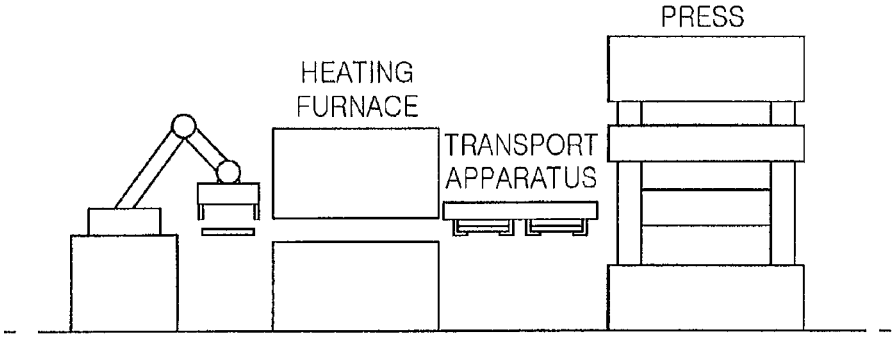
PRIOR ART Figure 2
FIG. 2 is a basic conceptual view illustrating a typical hot press forming (HPF) process.
Figure 3:
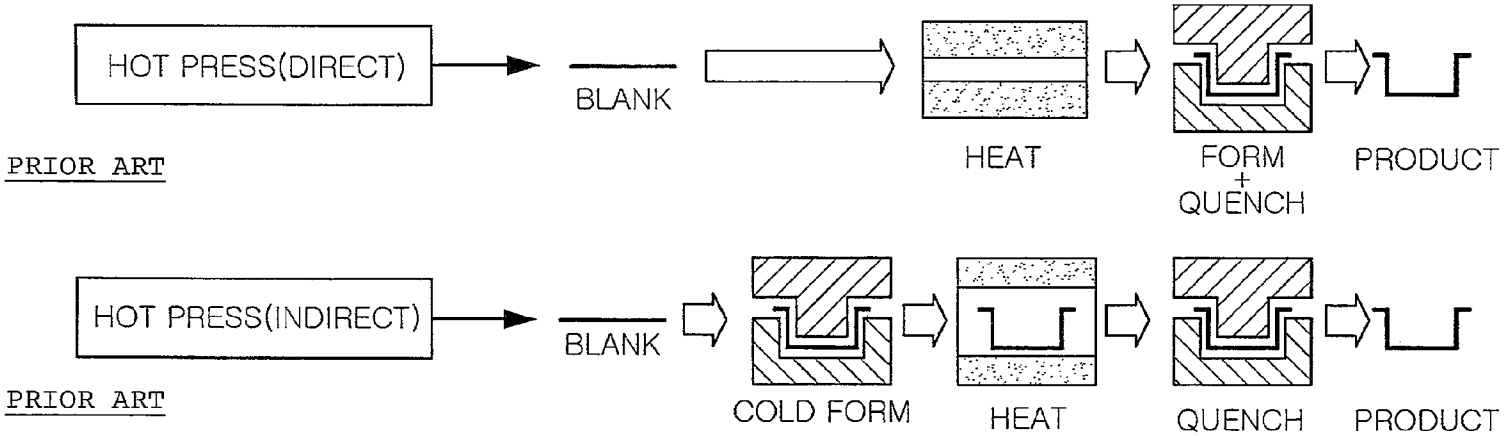
FIG. 3 is a conceptual view illustrating typical direct and indirect HPF processes.
Figure 4:
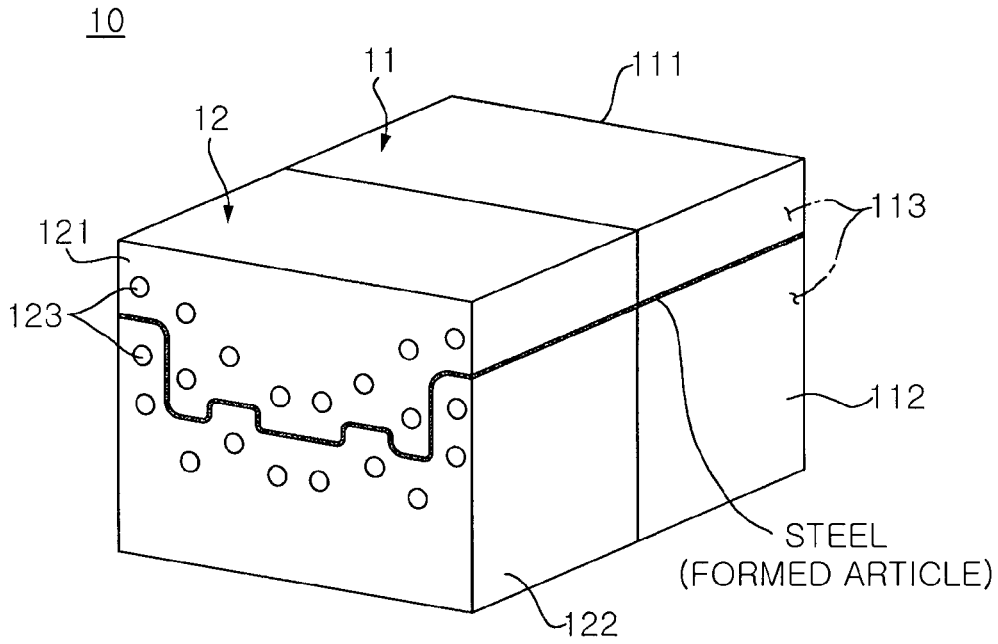
FIG. 4 is a schematic view illustrating an example of a forming apparatus including two separated die sets which may be applicable to a method of manufacturing a multi physical properties part according to the present invention.

A desirable example of the forming apparatus desirably applicable to the manufacturing of the multi physical properties part of the present invention is illustrated in FIG. 4.

As shown in FIG. 4, a forming apparatus 10 desirably applicable to the manufacturing of the multi physical properties part of the present invention includes separated die sets 11 and 12.

The one die set 11 includes an upper die 111 and a lower die 112, the other die set 12 includes an upper die 121 and a lower die 122, and a formed article having a targeted shape is manufactured by using the upper dies 111 and 121 and the lower dies 112 and 122.

The die sets 11 and 12 are separated structurally, so as to be operated independently of each other.

Cooling holes 113 and 123 are respectively included in the upper dies 111 and 121 and lower dies 112 and 122, formed to allow a coolant, such as cooling water, to flow in order to perform a function of maintaining die temperature as in the manufacturing of a typical hot press forming (HPF) part.

The forming apparatus 10 may include a heating means (not shown in FIG. 4) able to heat a steel in the die sets 11 and 12 or may be configured such that the die sets 11 and 12 are able to heat the steel.

The heating means heating the steel in the die sets 11 and 12 is not particularly limited and any heating means may be used if the heating means is typically used.

Although a forming apparatus including two separated die sets is illustrated in FIG. 4, the present invention is not limited thereto and a forming apparatus including three or more die sets may be used.

When the three or more separated die sets are used, it may be possible to allow a single part to include three or more regions having different physical properties from one another.

Hereinafter, a method of manufacturing a multi physical properties part of the present invention will be described in more detail according to FIG. 5.

Figure 5:
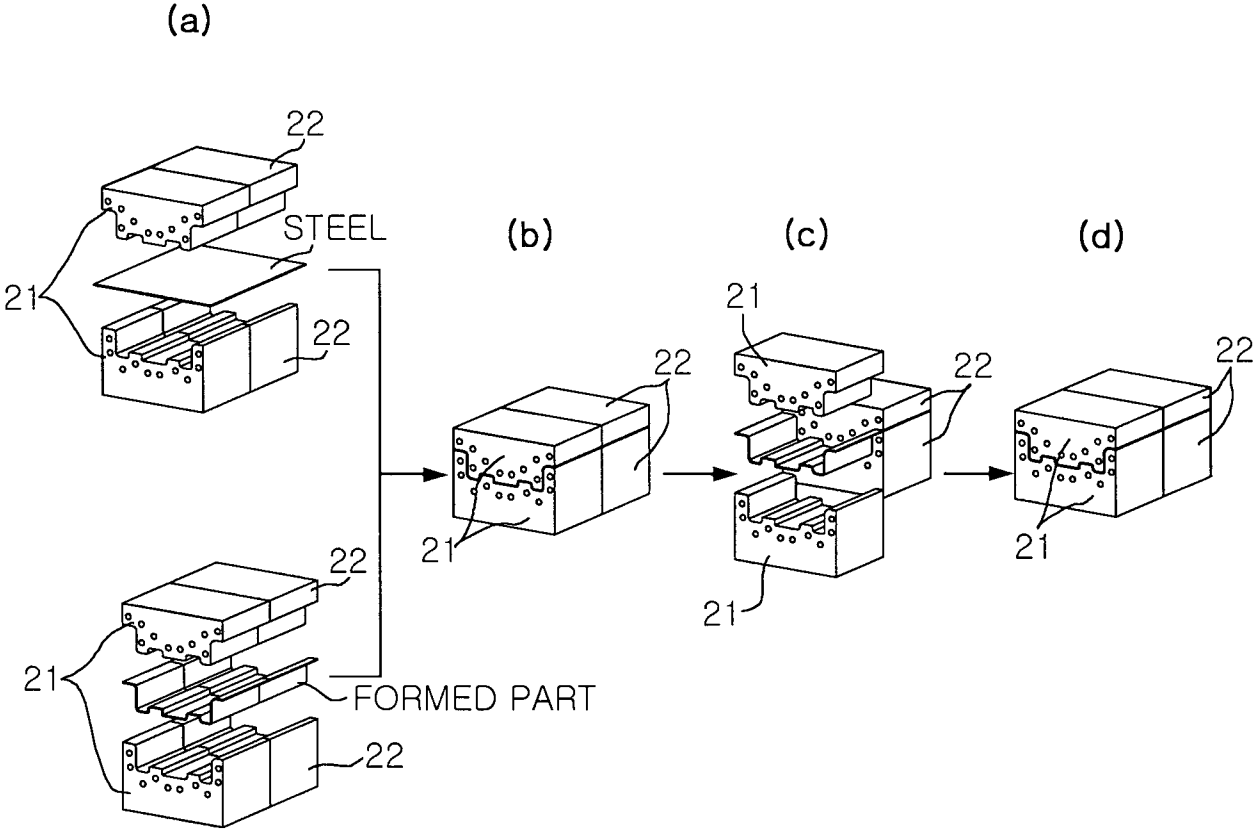
FIG. 5 is a conceptual view of a manufacturing process of a multi physical properties part illustrating a desirable example of the method of manufacturing a multi physical properties part according to the present invention.

In order to manufacture a multi physical properties part according to the present invention, a heated blank steel or a part formed at room temperature is heated and, as shown in FIG. 5, then positioned in separated die sets 21 and 22 [FIG. 5(*a*)]. Thereafter, forming and pre-quenching are performed with respect to the blank steel and pre-quenching is performed on the formed part [FIG. 5(*b*)].

The present invention may be applied to a part partially formed at room temperature and, in this case, the part is positioned in the die sets 21 and 22 to form a non-formed portion and simultaneously perform pre-quenching.

Next, the parts in the separated die sets 21 and 22 are cooled at differing cooling rates. For example, as shown in FIG. 5, the cooling is performed in such a manner, in which a low cooling rate region is obtained by separating one die set 21 so as to be not in contact with the part and air cooling the part, and a high cooling rate region is obtained by maintaining the other die set 22 to be in contact with the part and die quenching the part [FIG. 5(*c*)].

Also, as shown in FIG. 5, a low cooling rate region is obtained by separating one die set 21 so as to be not in contact with the part and air cooling the part to a certain temperature, and post-quenching (die quenching) may then be performed together with a high cooling rate region by contacting the die set 21 with the part again [FIG. 5(*d*)].

Hereinafter, the case, in which a physical property is tensile strength, is described as an example, but the present invention is not limited thereto.

Figure 6:
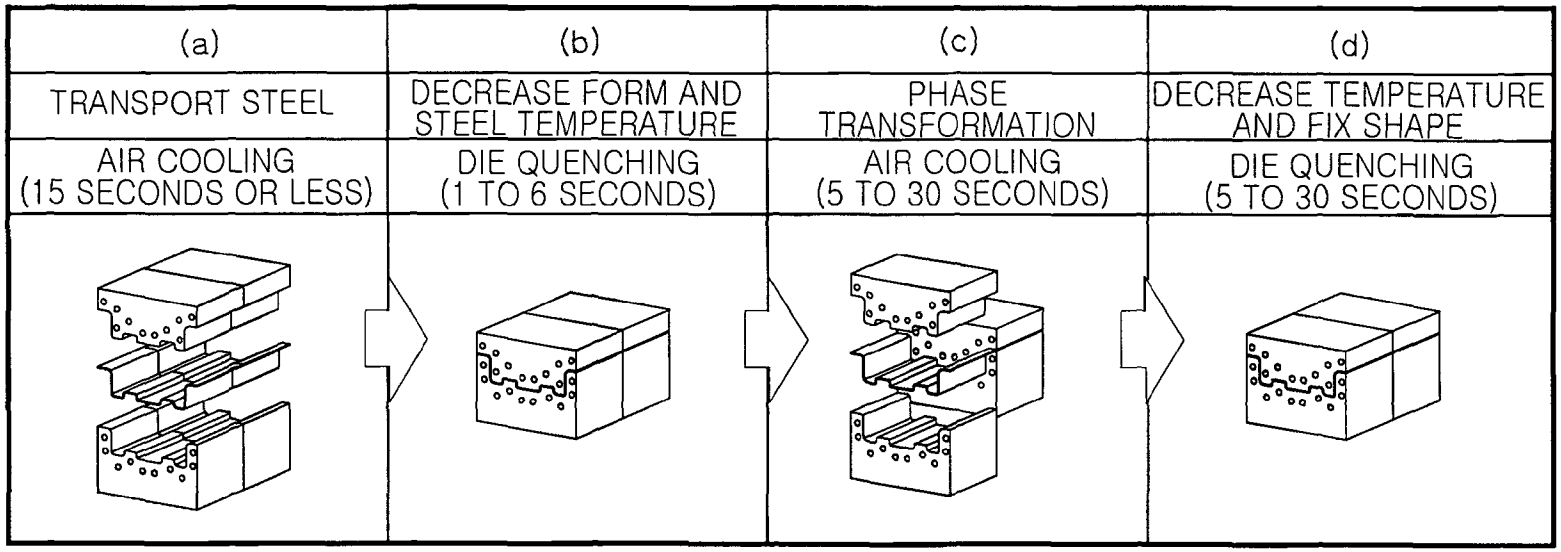
FIG. 6 is a conceptual view of a manufacturing process of a multi physical properties part illustrating a desirable example of a method of manufacturing a multi strength part according to the present invention.

FIG. 6 illustrates an example of a method of manufacturing a multi strength part according to the manufacturing method of the multi physical properties part of the present invention.

A steel, which will be manufactured as a multi strength part, is prepared and heated in a heating furnace.

At this time, heating may be performed by heating the steel above an $Ac_3$ transformation point for sufficient time to fully austenitize the steel.

The steel thus heated is extracted from the heating furnace and, as shown in FIG. 6, is transferred to a die set [FIG. 6(*a*)] to have forming and pre-quenching [FIG. 6(*b*)] operations performed thereupon.

Transport time required for transferring the steel to the die set after the extraction of the steel from the heating furnace is not particularly limited, but the transport time may be limited to 15 seconds or less.

The transport of the heated steel may be performed by using a robot or may be directly performed by a worker.

The forming and pre-quenching is a process in which the heated steel is formed into a part having a final shape and at the same time, the temperature thereof is decreased to a temperature at which phase transformation may be facilitated.

The forming and pre-quenching time is not particularly limited so long as the steel is formed into a targeted shape as well as a targeted structure able to be obtained, but the forming and pre-quenching time may be limited to a range of about 1 to 6 seconds. The forming and pre-quenching process time, for example, may be within a range of about 2 to 4 seconds.

The reason for this is that forming a part shape is sufficiently performed and temperature is sufficiently decreased in order to facilitate phase transformations of ferrite, pearlite, and bainite in a low-strength region.

A temperature of the steel, in which the forming and pre-quenching is terminated, may be appropriately selected according to the purposes thereof, but the temperature of the steel may be maintained within a range of about 500° C. to 800° C. For example, the temperature of the steel may be within a range of 550° C. to 650° C.

The forming and pre-quenching is performed as above, and air cooling is then performed on a region to obtain a relatively low-strength region, in which the die set and a formed article are not allowed to be in contact with each other [FIG. 6(*c*)]. Thereafter, post-quenching is performed while the die set and the formed article are in contact with each other again [FIG. 6(*d*)], die quenching is performed on a region to obtain a relatively high-strength region [FIG. 6(*d*)], in which the die set and the formed article are continuously in contact with each other after the forming and pre-quenching, and thus, a multi strength properties part may be manufactured.

An air-cooled state of the low-strength region is maintained by separating the die from the steel in order that the die and the steel are not in contact with each other.

Since a cooling rate in the air-cooled state is very slow, the steel may undergo a process of phase transformation, and austenite generated by heating may be transformed into one or more of ferrite, bainite, and pearlite.

A generated phase may be different from the composition of the steel, and since a magnitude of phase transformation is related to air cooling time, it is more advantageous to generate the low-strength region as the air cooling time is longer.

Although the air cooling time may be 5 seconds or more, the cooling time, for example, may be within a range of about 5 to 30 seconds when cycle time is considered.

On the other hand, since the steel and the die are continuously in contact with each other in the high-strength region, a fast cooling rate is maintained.

Therefore, high strength may be obtained in the foregoing region because austenite is directly transformed into martensite.

Different from the continuously die-quenched high-strength region, the air-cooled low-strength region may maintain a high temperature of 400° C. or more.

A post-quenching process, in which quenching is performed by contacting a total surface of the part with the die, is necessary for preventing shape distortion due to the temperature deviation for sections during the extraction of the part and for the completion of martensite transformation.

Post-quenching process time may be changed according to a part extraction temperature and a mold material, and may be 5 seconds or more. For example, the post-quenching process time may be within a range of 5 seconds to 30 seconds when cycle time is considered.

Hereinafter, the present invention will be described in more detail, according to examples.

Example 1

Figure 7A:
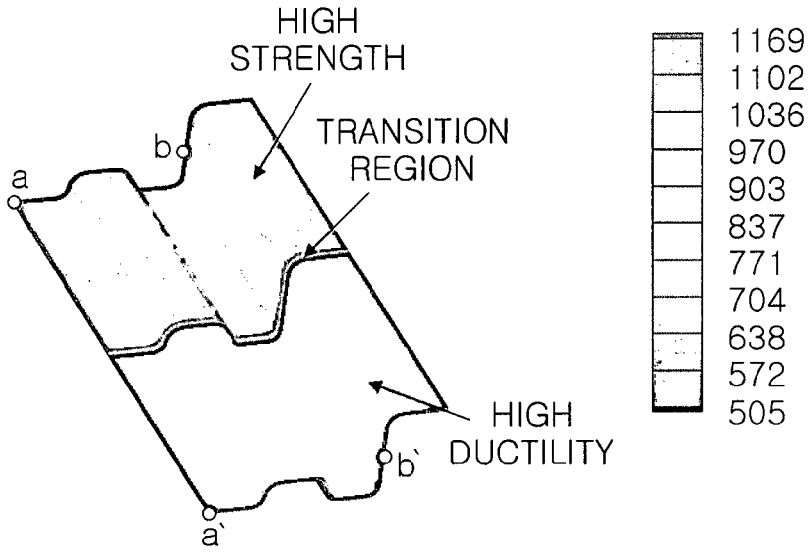
FIG. 7 is tensile strength and structure distribution diagrams of a multi strength part manufactured according to the method of manufacturing a multi physical properties part of the present invention.
Figure 7B:
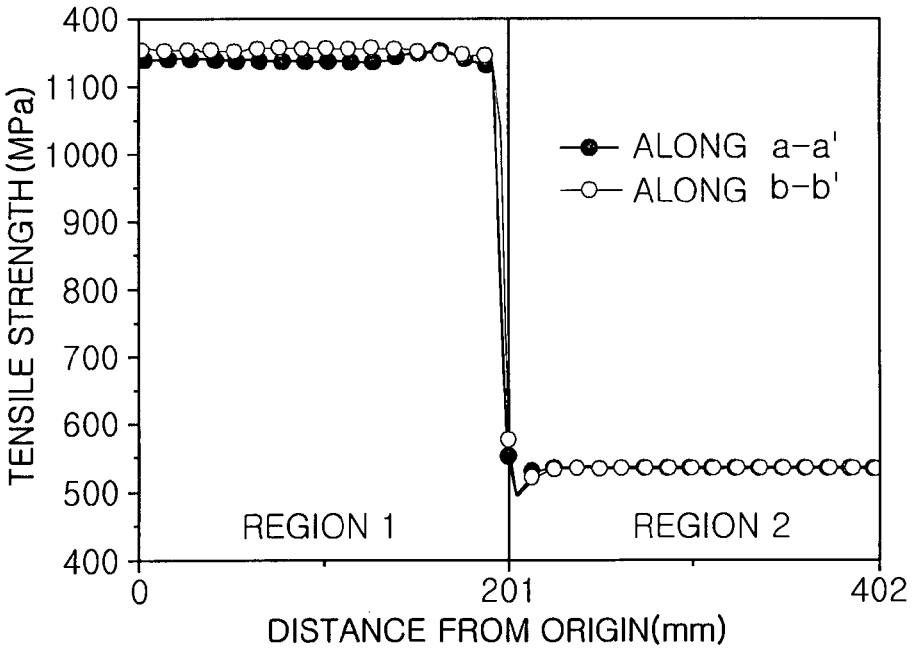
Figure 7C:
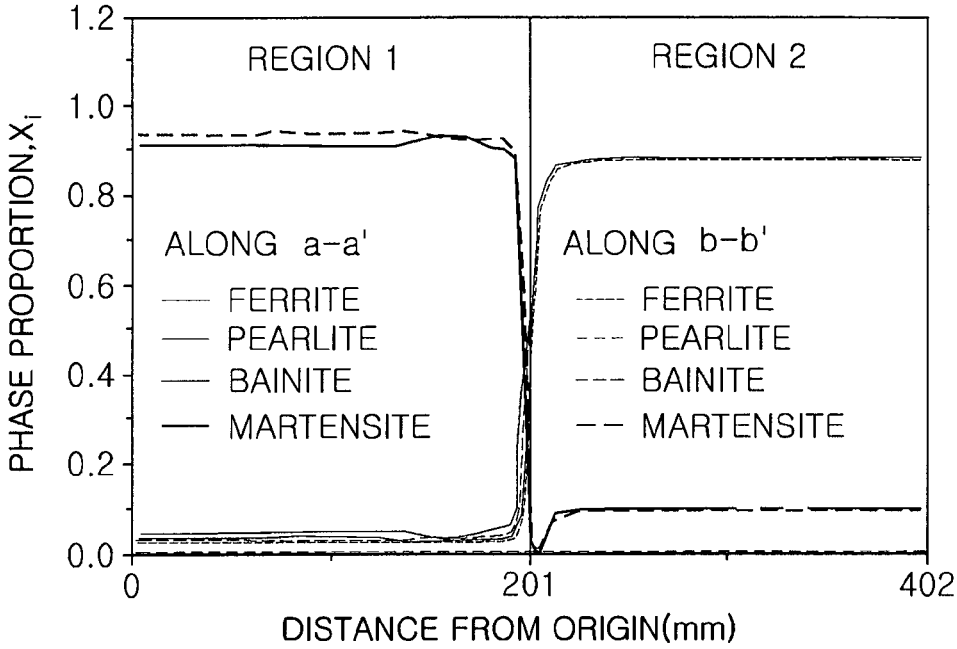
Figure 8A:
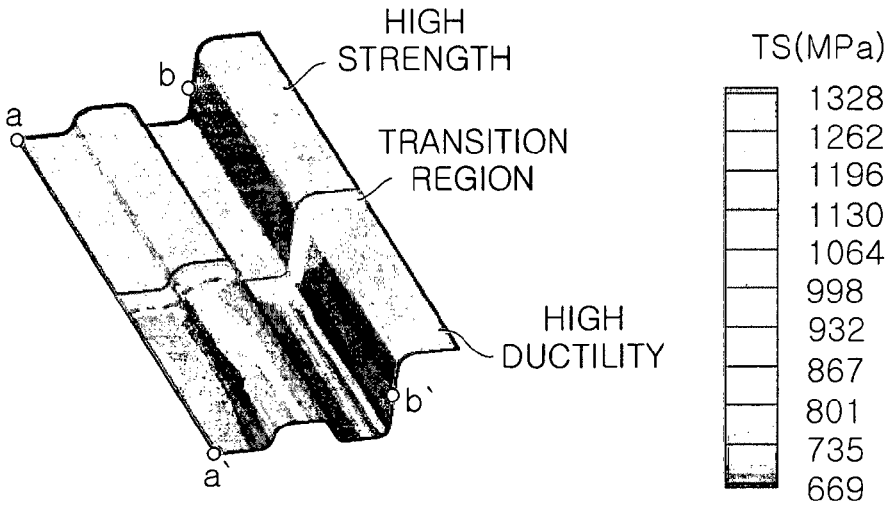
FIG. 8 is tensile strength and structure distribution diagrams of another multi strength part manufactured according to the method of manufacturing a multi physical properties part of the present invention.
Figure 8B:
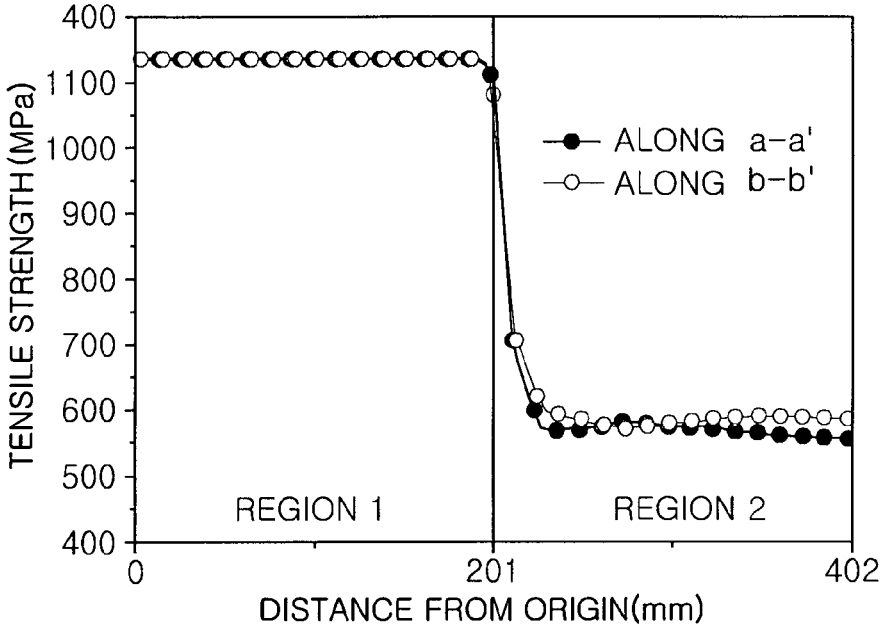
Figure 8C:
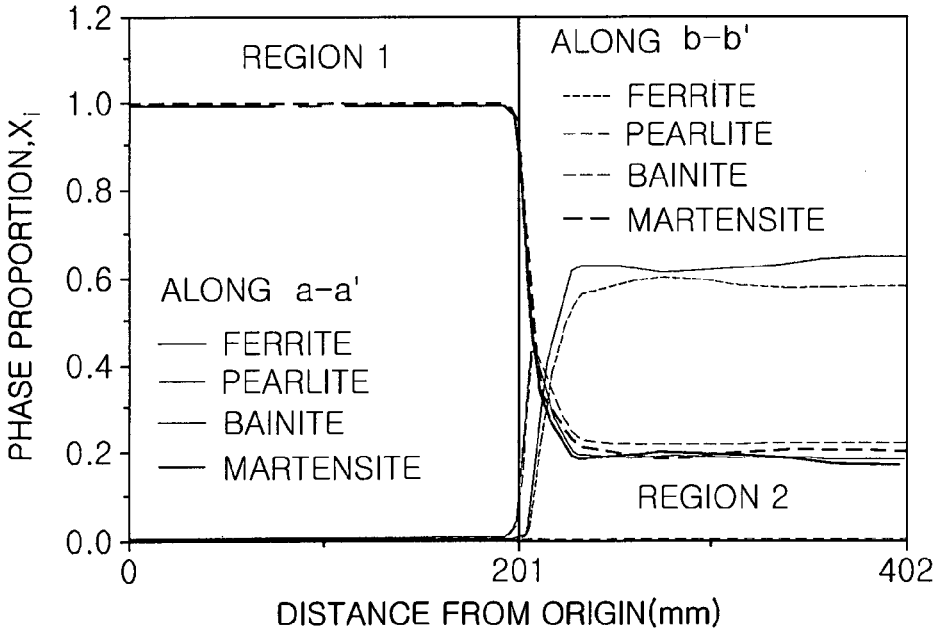
Figure 9:
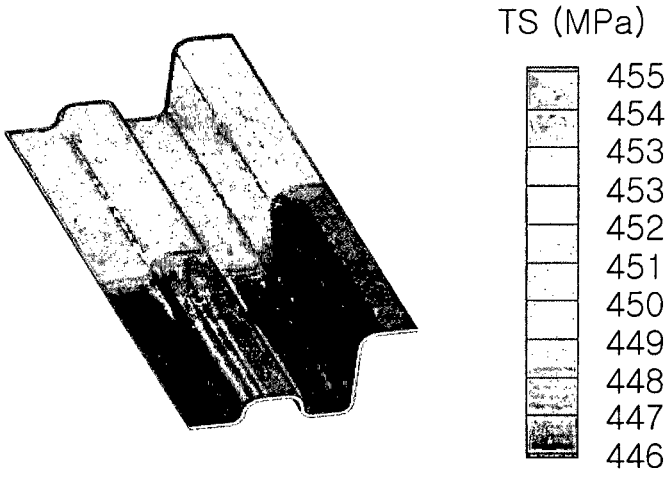
FIG. 9 is tensile strength distribution diagrams of another multi strength part manufactured according to the method of manufacturing a multi physical properties part of the present invention.
Figure 9:
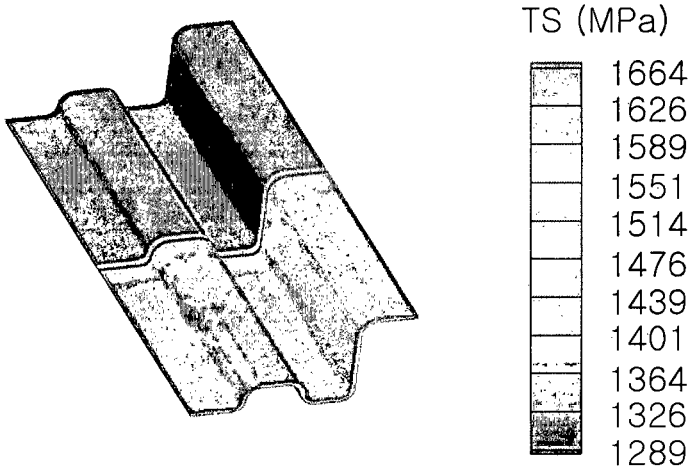
Figure 10A:
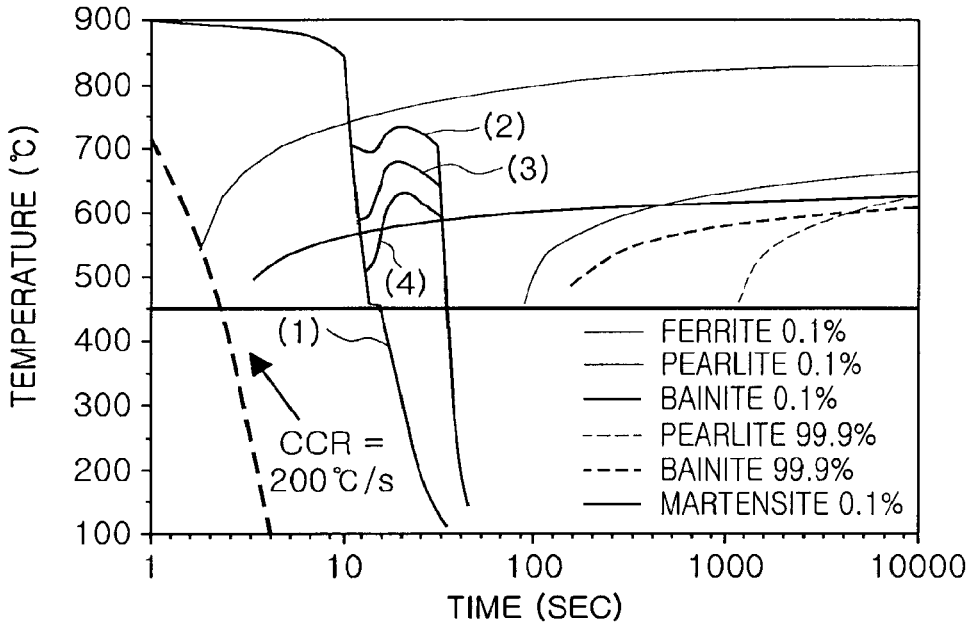
FIG. 10 is continuous cooling transformation (CCT) diagrams illustrating critical cooling rates (CCR) of steels.
Figure 10B:
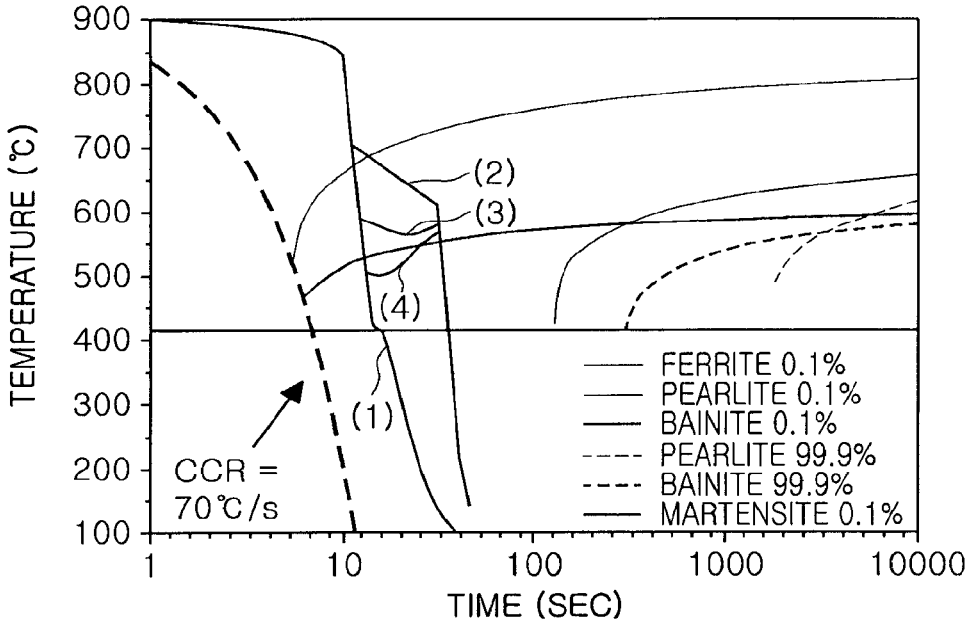
Figure 10C:
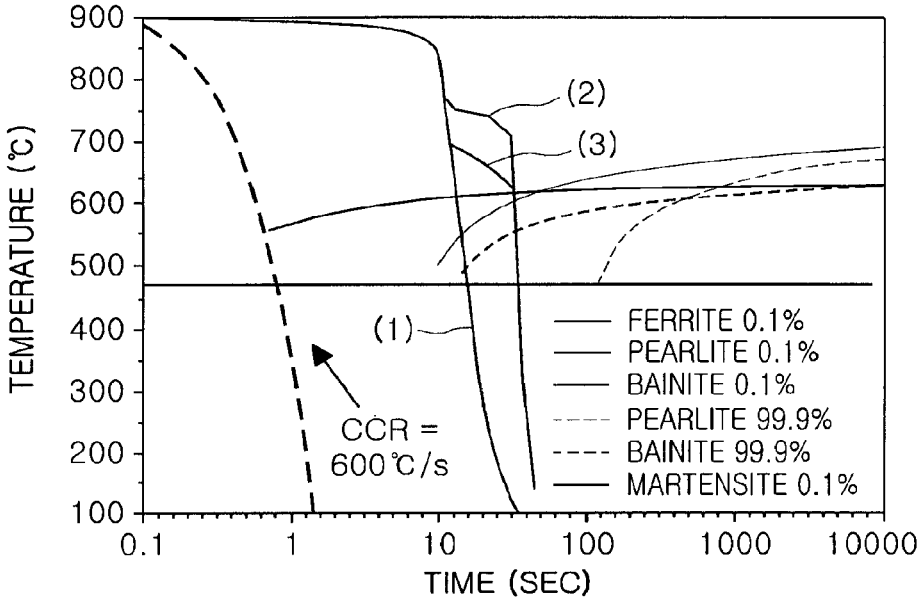
Figure 10D:
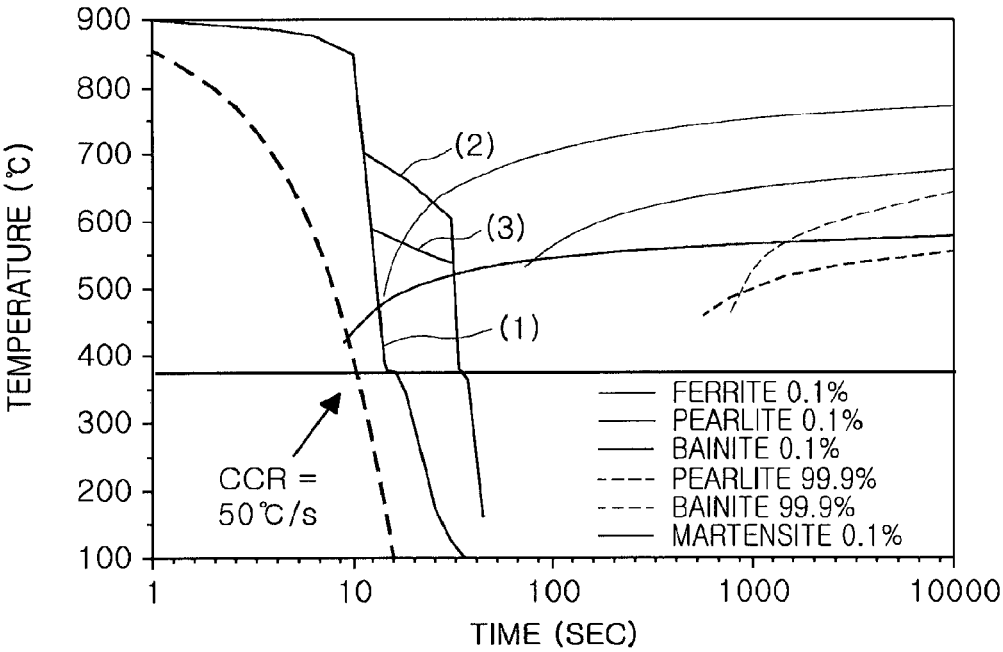

Steels having compositions of the following Table 1 were manufactured as multi strength parts by using the die sets appeared in FIG. 5 under manufacturing conditions of the following Table 2, and the results thereof are then presented in FIGS. 7 to 9.

The results in FIGS. 7 to 9 are shown with respect to halves of the parts.

FIGS. 7(*a*), (*b*), and (*c*) show the results with respect to steel A, FIGS. 8(*a*), (*b*), and (*c*) show the results with respect to steel B, FIG. 9(*a*) shows the results with respect to steel C, and FIG. 9(*b*) shows the results with respect to steel D.

Tensile strengths of the steels A, B, C, and D in the following Table 1, before applying a process of manufacturing a part, were 465 MPa, 649 MPa, 506 MPa, and 716 MPa, respectively.

In the following Table 2, transport times denote time elapsed after a heated steel was removed from a heating furnace until the heated steel was introduced into a forming apparatus.

TABLE 1

| Steels | C | Si | Mn | P | S | Al | Mo | Ti | Nb | Cu | B | N | W | Sb |
|---|---|---|---|---|---|---|---|---|---|---|---|---|---|---|
| A | 0.08 | 0.120 | 1.300 | 0.017 | 0.0002 | 0.035 | 0.040 | — | — | — | 0.0008 | 0.00005 | — | — |
| B | 0.127 | 0.159 | 1.649 | 0.015 | 0.0011 | 0.0480 | 0.0639 | 0.0024 | 0.0006 | 0.0104 | 0.0019 | 0.0072 | 0.0009 | 0.0005 |
| C | 0.082 | 0.248 | 0.878 | 0.020 | 0.0026 | 0.0274 | 0.0011 | 0.0019 | 0.0285 | 0.0138 | 0.0001 | 0.0032 | 0.0005 | 0.0004 |
| D | 0.254 | 0.245 | 1.561 | 0.010 | 0.0020 | 0.0268 | 0.0015 | 0.0469 | 0.0005 | 0.0098 | 0.0017 | 0.0123 | 0.0316 | 0.0004 |

TABLE 2

| High-strength region | | Low-strength region | | | | |
|---|---|---|---|---|---|---|
| Transport time (sec) | Forming & die-quenching time (sec) | Transport time (sec) | Forming & pre-quenching time (sec) | Air cooling time (sec) | Post-quenching time (sec) | Cycle time (sec) |
| 10 | 37 | 10 | 2 | 20 | 15 | 47 |

As shown in FIGS. 7(*a*), (*b*), and (*c*), with respect to the steel A, it may be understood that tensile strength in a high-strength region of the part was 1100 MPa or more and tensile strength in a low-strength region was about 500 MPa.

In terms of phase distribution, it may be understood that martensite was predominantly formed in the high-strength region and ferrite was predominantly formed in the low-strength region.

Also, as shown in FIGS. 8(*a*), (*b*), and (*c*), with respect to the steel B, it may be understood that tensile strength in a high-strength region of the part was 1300 MPa or more and tensile strength in a low-strength region was about 700 MPa.

In terms of phase distribution, it may be understood that full martensite was formed in the high-strength region and ferrite, martensite, and bainite were formed in the low-strength region. According to the foregoing results, it may be understood that a multi strength part may be easily manufactured according to the present invention and strength distribution may be controlled according to materials.

Meanwhile, as shown in FIG. 9(*a*), an overall decrease in strength was generated with respect to the steel C. Therefore, it may be understood that the steel C was a steel having a very low hardenability.

As shown in FIG. 9(*b*), an overall increase in strength was rapidly generated with respect to the steel D.

Therefore, the steel D was a steel having a very high hardenability.

According to the foregoing results, the manufacturing of a multi strength part may not be possible according to steel characteristics, and it may be understood that this may be in close relationship with the hardenability of steel. That is, a material having very low or very high hardenability may not be applied to manufacture a multi strength part according to the suggested invention.

Example 2

Critical cooling rates (CCR), which were minimum cooling rates able to form martensite phases in continuous cooling transformation (CCT) curves with respect to the steels A, B, C, and D suggested in Table 1 of Example 1, were investigated and the results thereof are presented in FIG. 10.

FIG. 10(*a*) shows the results of the steel A, FIG. 10(*b*) shows the results of the steel B, FIG. 10(*c*) shows the results of the steel C, and FIG. 10(*d*) shows the results of the steel D.

As shown in FIG. 10, it may be understood that a critical cooling rate of steel A was about 200° C./s and a critical cooling rate of steel B was about 70° C./s. With respect to the foregoing two steels, multi strength parts may be manufactured by the process of the present invention as revealed in Example 1.

On the other hand, it may be understood that a critical cooling rate of steel C was 600° C./s and a critical cooling rate of steel D was about 50° C./s. With respect to the foregoing two steels, it may be difficult to manufacture multi strength parts by the process of the present invention as revealed in Example 1.

According to the foregoing results, it may be understood that a critical cooling rate may be greatly affected in selecting a steel of which a multi strength part may be manufactured according to the process of the present invention.

The present inventors have confirmed, through a great deal of experimentation, that a critical cooling rate of a steel desirably applicable to the manufacturing of the multi strength part of the present invention is greater than 50° C./s and less than 600° C./s.

For example, the critical cooling rate of the steel may be greater than 70° C./s and less than 200° C./s.

While the present invention has been shown and described in connection with the exemplary embodiments, it will be apparent to those skilled in the art that modifications and variations can be made without departing from the spirit and scope of the invention as defined by the appended claims.

The invention claimed is:

1. A method of manufacturing a multi physical properties part, the method comprising:

forming a single heated steel by using two or more separated die sets; and then manufacturing the single heated steel into a multi physical properties part including two or more regions having different physical properties by differing cooling conditions in the respective die set.

2. The method of claim 1, wherein the physical properties is one selected from the group consisting of yield strength, tensile strength, elongation, toughness, a plastic anisotropy index (r), and in-plane anisotropy (Δr).

3. The method of claim 2, wherein the physical properties is tensile strength and a critical cooling rate (CCR), a minimum cooling rate able to form a martensite phase in a continuous cooling transformation (CCT) curve, of the steel is greater than about 50° C./s and less than about 600° C./s.

4. The method of claim 3, wherein the method further comprising:

forming and pre-quenching the steel by using two or more separated die sets, after heating the steel above an $Ac_3$ transformation point;

air cooling a region to obtain a relatively low-strength region, in which the die set and a formed article are not allowed to be in contact with each other, and then post-quenching while the die set and the formed article are in contact with each other again; and die quenching a region to obtain a relatively high-strength region, in which the die set and the formed article are continuously in contact with each other after the forming and pre-quenching.

5. The method of claim 4, wherein martensite is formed to about 80 vol % or more in the high-strength region, and one or more of ferrite, bainite, and pearlite or one or more of ferrite, bainite, and pearlite and about 50 vol % or less of martensite are formed in the low-strength region.

6. The method of claim 4, wherein the forming and pre-quenching time is within a range of about 1 second to about 6 seconds.

7. The method of claim 4, wherein the air cooling time is within a range of about 5 seconds to about 30 seconds.

8. The method of claim 4, wherein the post-quenching time is within a range of about 5 seconds to about 30 seconds.

9. A method of manufacturing a multi physical properties part, the method comprising:

positioning a single heated formed article in two or more separated die sets; and then manufacturing the single heated formed article into a multi physical properties part including two or more regions having different physical properties by differing cooling conditions in the respective die set.

10. A method of manufacturing a multi physical properties part, the method comprising:

forming and pre-quenching a non-formed portion by using two or more separated die sets, after heating a partially formed article formed of a steel above an $Ac_3$ transformation point;

air cooling a region to obtain a relatively low-strength region, in which the die set and the formed article are not allowed to be in contact with each other, and then post-quenching while the die set and the formed article are in contact with each other again; and die quenching a region to obtain a relatively high-strength region, in which the die set and the formed article are continuously in contact with each other after the forming and pre-quenching.

* * * * *